US006652050B2

(12) United States Patent
Lin

(10) Patent No.: US 6,652,050 B2
(45) Date of Patent: Nov. 25, 2003

(54) DRAWER-SLIDING DEVICE

(75) Inventor: Chun Wei Lin, Taipei (TW)

(73) Assignee: Nan Juen International Co., Ltd. (TW)

( * ) Notice: Subject to any disclaimer, the term of this patent is extended or adjusted under 35 U.S.C. 154(b) by 0 days.

(21) Appl. No.: 10/123,193

(22) Filed: Apr. 17, 2002

(65) Prior Publication Data

US 2003/0127957 A1 Jul. 10, 2003

(30) Foreign Application Priority Data

Jan. 10, 2002 (TW) ..... 91200116 U

(51) Int. Cl.[7] ..... A47B 88/00
(52) U.S. Cl. ..... 312/333; 312/334.46
(58) Field of Search ..... 312/333, 334.44, 312/334.45, 334.46, 334.47, 334.7, 334.8, 330.1, 319.1; 384/21, 22

(56) References Cited

U.S. PATENT DOCUMENTS 5,356,207 A * 10/1994 Rock et al. ..... 312/334.46
5,364,179 A * 11/1994 Brustle et al. ..... 312/333
5,474,375 A * 12/1995 Hollenstein et al. ..... 312/319.1
6,340,078 B1 * 1/2002 Scheible ..... 188/166

FOREIGN PATENT DOCUMENTS

WO WO 01/82749 A2 11/2001

* cited by examiner

*Primary Examiner*—Janet M. Wilkens
(74) *Attorney, Agent, or Firm*—Bacon & Thomas, PLLC

(57) ABSTRACT

A drawer-sliding device. The device includes an outer sliding member fastened with a cabinet or the like. A middle sliding member is mounted slidably in the outer sliding member, and an inner sliding member is fastened with the drawer and mounted slidably in the middle sliding member. The inner sliding member is provided with a coupling element. The outer sliding member is provided with a fast return element and a spring element. When the inner sliding member and the drawer are drawn out, the coupling element of the inner sliding member is engaged with the fast return element so as to bring about an outward displacement of the fast return element, thereby resulting in deformation of the spring element. When the inner sliding member is pushed back into place along with the drawer, the fast return element and the coupling element are forced by the spring element to move back into place.

6 Claims, 4 Drawing Sheets

DRAWER-SLIDING DEVICE

FIELD OF THE INVENTION

The present invention relates generally to a drawer of a cabinet and the like, and more particularly to a device to enable the drawer to be drawn out and then pushed back into place.

BACKGROUND OF THE INVENTION

The drawer of a cabinet or the like can be drawn out and then pushed back into place by means of a sliding device. The conventional sliding device comprises an additional means to hold the drawer securely in place, so as to prevent the drawer from sliding out on its own. The case in point is a device which is disclosed in WO 01/82749 A2. This prior art device works as expected; nevertheless it is rather complicated in construction and is therefore not cost-effective. The prior art device is mounted on one end of an outer sliding member which is fastened to the cabinet. In light of the one end of the outer sliding member being allocated to mount the device, the one end of the outer sliding member can not be fixed with the cabinet by a fastener, thereby compromising the operating efficiency of the drawer. In addition, the outer sliding member is susceptible to being detached from the cabinet, with the prior art device being the main culprit. Moreover, the prior art device comprises a spring which is limited in effective distance and thus the self-closing function can only be activated within a limited distance.

SUMMARY OF THE INVENTION

The primary objective of the present invention is to provide a drawer sliding device which is free of the deficiencies of the prior art device described above.

The drawer-sliding device of the present invention, which enables a drawer of a cabinet or the like to be drawn out and then pushed back into place, comprises:

an outer sliding member adapted to be fastened to two opposite inner sides of the cabinet or the like;

a middle sliding member capable of sliding back and forth in said outer sliding member;

an inner sliding member adapted to be fastened to two opposite outer sides of the drawer such that said inner sliding member is capable of sliding back and forth in said middle sliding member; wherein said inner sliding member is provided at one end with a coupling element; and said outer sliding member is provided at one end with a fastening seat which is provided with a holding mechanism, a fast return element capable of sliding back and forth in said fastening seat, and an spring mechanism fastened with a fringe of said fastening seat;

wherein said fast return element is coupled with said coupling element of said inner sliding member at such time when said inner sliding member is drawn out of the cabinet or the like along with the drawer, resulting in an outward displacement of said fast return element, such that said fast return element is retained by said holding mechanism of said fastening seat, and that said fast return element is disengaged with said coupling element, and that said spring mechanism is deformed;

said fast return element will be once again engaged with said coupling element and forced by said spring mechanism to move away from said holding mechanism at the time when said drawer and said inner sliding member are pushed back into the cabinet or the like.

Preferably, said spring mechanism comprises a tension spring, and said tension spring is disposed in the fringe of said fastening seat such that said tension spring is fastened at two ends thereof with said fast return element.

Preferably, said spring mechanism comprises two tension springs, with each being disposed in the fringe of said fastening seat such that each of said two tension springs is fastened at one end with said fastening seat and at other end with said fast return element.

Alternatively, said spring mechanism comprises two compression springs, and each of said two compression springs is in contact at one end with said fastening seat and in contact at other end with said fast return element.

Preferably, said coupling element has an upright wall, wherein said fast return element has a hooked portion capable of catching detachably said upright wall of said coupling element.

Preferably, said inner sliding member is provided at one end with an insertion portion having an opening, wherein said coupling element is connected to said insertion portion.

Preferably, said fastening seat is provided in two sides thereof with two slide slots, and said fast return element has two fastening portions, wherein said two fastening portions are slidably received in said two slide slots. Said holding mechanism preferably comprises two recesses which are located respectively at one end of said slide slots and are perpendicular to said slide slots.

Preferably, said fastening seat is provided with a space located between said two slide slots to accommodate a fastener such as a screw for fastening said outer sliding member to said cabinet or the like.

The spring mechanism of the present invention has an increased free length so as to avert the spring fatigue of the spring mechanism, thereby resulting in enhancement of operational efficiency and longevity of the device of the present invention. Moreover, the increased free length of the spring mechanism also serves an earlier activation of the self-closing function of the drawer-sliding device of the present invention.

DETAILED DESCRIPTION OF THE PREFERRED EMBODIMENT

Figure 1:
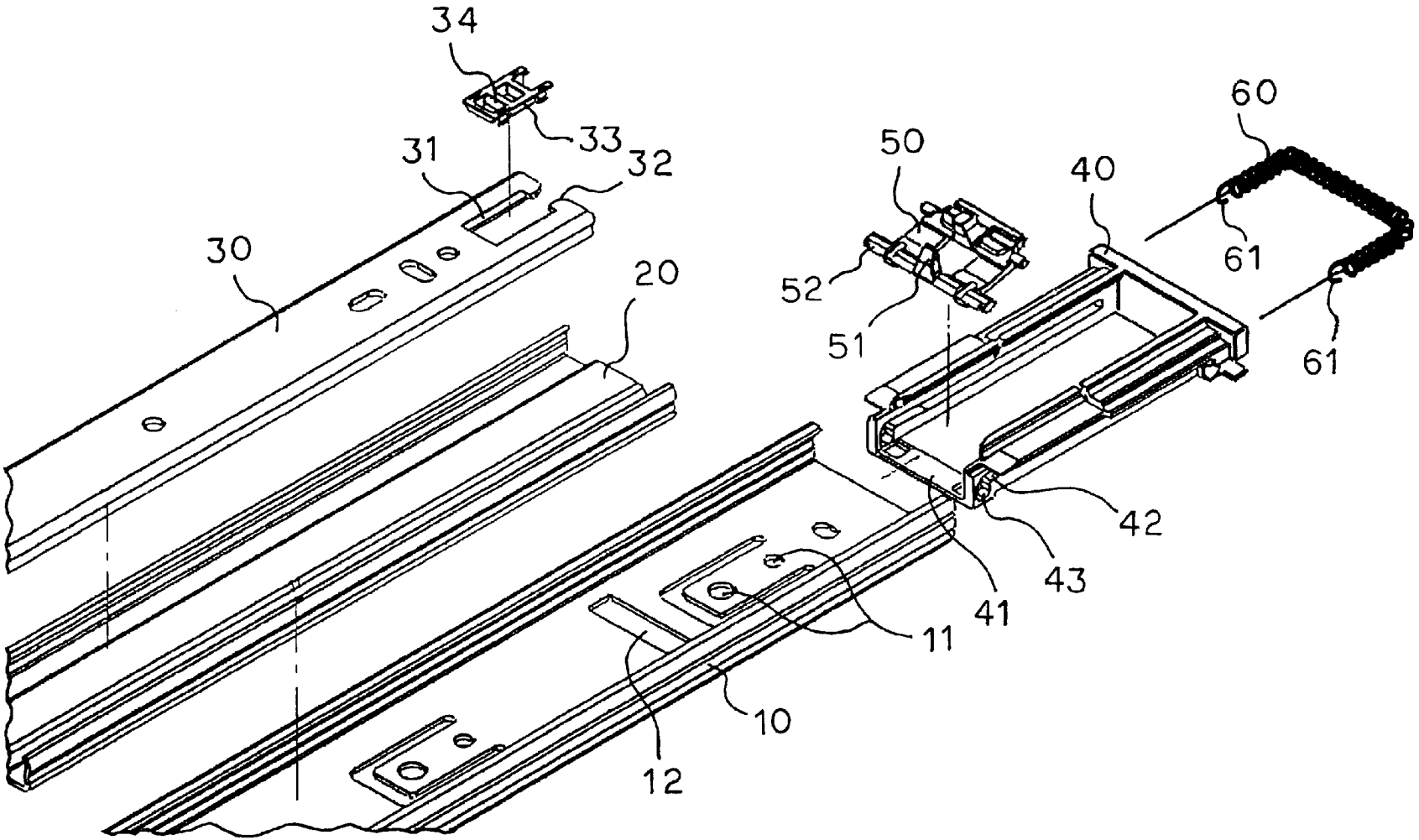
FIG. 1 shows an exploded view of a preferred embodiment of the present invention.
Figure 2:
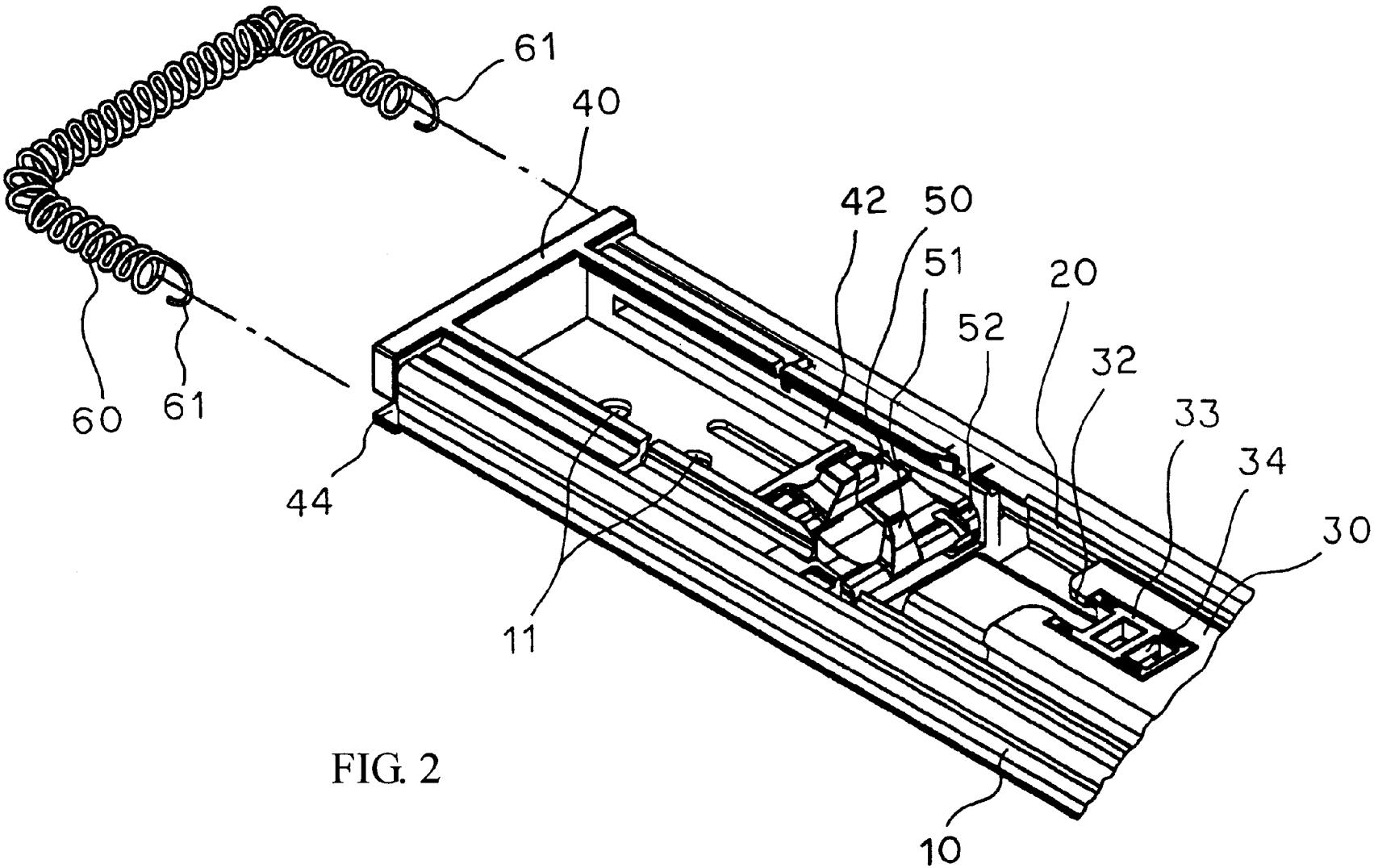
FIG. 2 shows a perspective view of the preferred embodiment of the present invention in combination.
Figure 3:
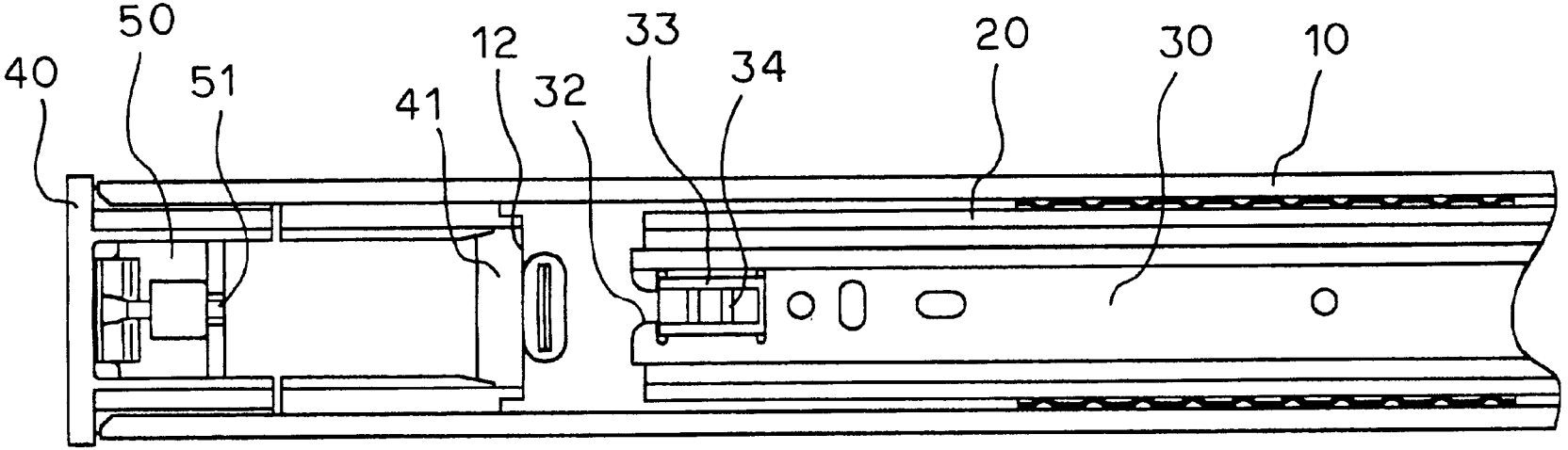
FIG. 3 shows a schematic plan view of the preferred embodiment of the present invention in combination.

As shown in FIGS. 1–3, a device embodied in the present invention comprises the component parts which are described hereinafter.

An outer sliding member 10 is fastened to two opposite inner sides of a cabinet or the like and is provided in proximity of one end thereof with a screw hole 11 and a retaining hole 12.

A middle sliding member 20 is slidably joined with the outer sliding member 10 such that the middle sliding member 20 is capable of a reciprocating motion in the outer sliding member 10.

An inner sliding member 30 is fastened to two opposite outer sides of a drawer such that the inner sliding member 30 is capable of sliding back and forth in the middle sliding member 20. The inner sliding member 30 is provided at one end with an insertion portion 31 which is provided with an opening 32.

A coupling element 33 is disposed in the insertion portion 31 of the inner sliding member 30. The coupling element 33 has an upright wall 34.

A fastening seat 40 is provided at one end with a retaining portion 41, which is retained in the retaining hole 12 of the outer sliding member 10. The fastening seat 40 is provided in two sides thereof with two slide slots 42, each having at one end thereof a recess 43 perpendicular to said slide slot to serve as a holding mechanism. The fastening seat 40 is provided at other end with a groove 44.

A fast return element 50 is provided in two sides with two columnar fastening portions 52 capable of sliding back and forth in the fastening seat 40. The fast return element 50 is further provided a hooked portion 51 which is intended to catch the upright wall 34 of the coupling element 33. The hooked portion 51 is provided with an inclined plane which faces the coupling element 33, so as to facilitate the coupling of the fast return element 50 with the coupling element 33.

A tension spring 60 is disposed in the fringe of the fastening seat 40 such that two ends 61 of the tension spring 60 are fastened with the two columnar fastening portions 52 of the fast return element 50.

The fastening seat 40 is further provided with a space which is located between two slide slots 42 to accommodate a fastener, such as a fastening screw.

Figure 4:
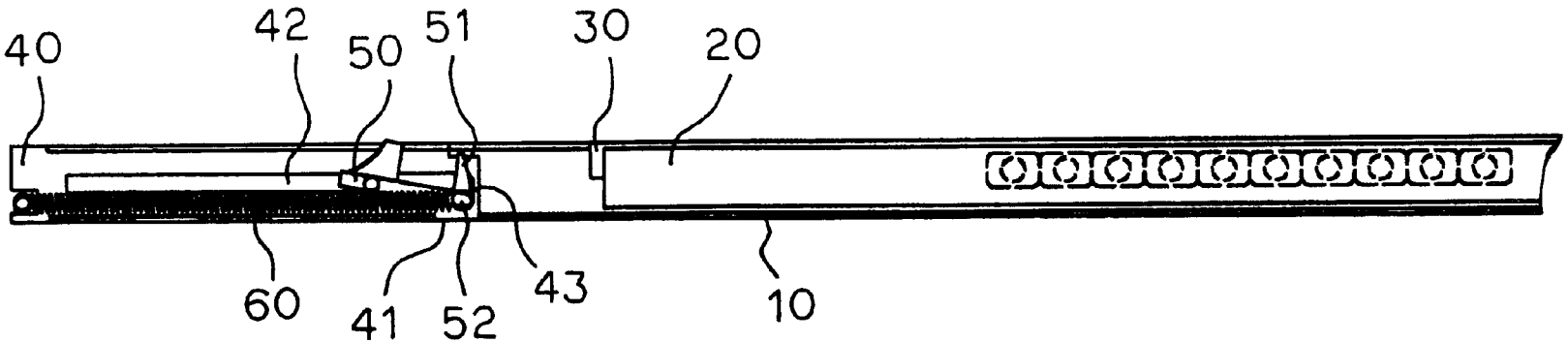
FIG. 4 shows a sectional schematic view of the preferred embodiment, of the present invention in action.

In operation, when the drawer and the inner sliding member 30 are drawn out, the upright wall 34 of the coupling element 33 is connected with the hooked portion 51 of the fast return element 50 which is thus displaced outwards such that the fastening portions 52 of the fast return element 50 are stopped at the end of the moving range of the slide slots 42 of the fastening seat 40. In the meantime, the upright wall 34 of the coupling element 33 is disengaged with the hooked portion 51 of the fast return element 50, and the fastening portions 52 of the fast return element 50 are retained in the recesses 43 of the slide slots 42. The tension spring 60 is pulled by the fast return element 50 to expand, as shown in FIGS. 2 and 4.

Figure 5:
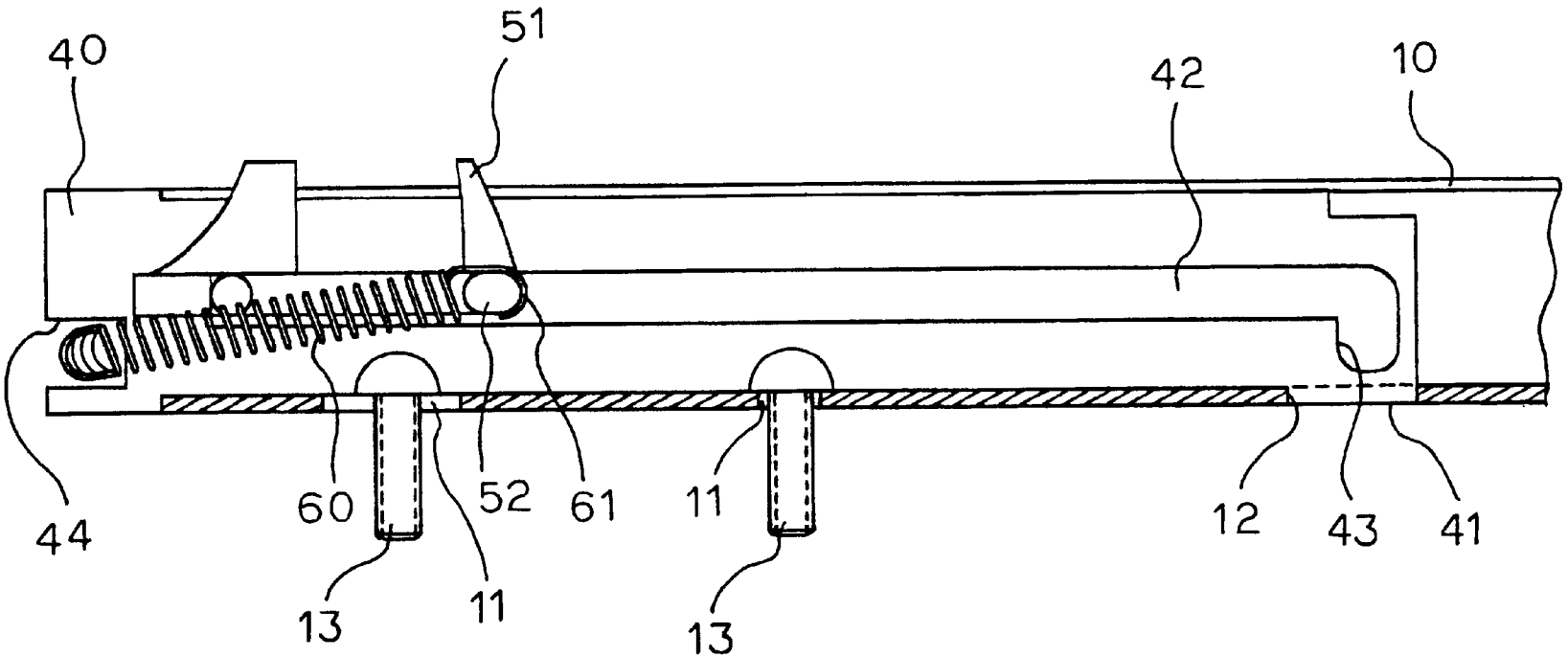
FIG. 5 shows an enlarged sectional view of the preferred embodiment of the present invention in action.

As the drawer and the inner sliding member 30 are pushed back into place, the upright wall 34 of the coupling element 33 is coupled with the hooked portion 51 of the fast return element 50, and the fastening portions 52 are pushed away from the recesses 43, thereby resulting in the inner sliding member 30 being pulled back Into place by the tension spring 60. The inner sliding member 30 is thus located securely in place such that the inner sliding member 30 does not slide outwards on its own. The relationship between the fast return element 50 and the tension spring 60 is illustrated in FIG. 5.

The device of the present invention may be provided with two tension springs instead of only one tension spring 60. That is the tension spring 60 is cut off at one point in the groove 44 of the fastening seat 40, and the resulting two ends are fastened to the fastening seat 40. In further another embodiment, the two tension springs may be replaced by two compression springs. In this embodiment, when the fastening portions 52 of the fast return element 50 are retained in the recesses 43 of the slide slots 42 of the fastening seat 40, the two compression springs are compressed. When the drawer and the inner sliding member 30 are pushed back into place, the coupling element 33 is coupled with the fast return element 50. The inner sliding member 30 is pulled back into place by an expansion force of the compressed compression spring.

What is claimed is:

1. A device to enable a drawer of a cabinet to be drawn out and then pushed back into place, said device comprising:

an outer sliding member configured to be fastened to the cabinet;

a middle sliding member capable of sliding back and forth in said outer sliding member;

an inner sliding member configured to be fastened to the drawer such that said inner sliding member is capable of sliding back and forth in said middle sliding member;

said inner sliding member is provided at one end with a coupling element; and said outer sliding member is provided at one end with a fastening seat which is provided with a holding mechanism, a fast return element capable of sliding back and forth in said fastening seat, and a spring mechanism fastened with a fringe of said fastening seat;

said fast return element is coupled with said coupling element of said inner sliding member at such time when said inner sliding member is drawn out of the cabinet along with the drawer, resulting in an outward displacement of said fast return element, such that said fast return element is retained by said holding mechanism of said fastening seat, and that said fast return element is disengaged with said coupling element, and that said spring mechanism is deformed; and said fast return element will be once again engaged with said coupling element and forced by said spring mechanism to move away from said holding mechanism at the time when said drawer and said inner sliding member are pushed back into the cabinet.

2. The device as claimed in claim 1, wherein said spring mechanism comprises a tension spring, and said tension spring is disposed in the fringe of said fastening seat such that said tension spring is fastened at two ends thereof with said fast return element.

3. The device as claimed in claim 1, wherein said coupling element has an upright wall; wherein said fast return element has a hooked portion capable of catching detachably said upright wall of said coupling element.

4. The device as claimed in claim 1, wherein said inner sliding member is provided at one end with an insertion portion having an opening; wherein said coupling element is connected to said insertion portion.

5. The device as claimed in claim 1, wherein said fastening seat is provided in two sides thereof with two slide slots; wherein said fast return element has two fastening portions, and said two fastening portions are slidably received in said two slide slots; wherein said holding mechanism comprises two recesses which are located respectively at one end of said slide slots and are perpendicular to said slide slots.

6. The device as claimed in claim 5, wherein said fastening seat is provided with a space located between said two slide slots to accommodate a fastener for fastening said outer sliding member to said cabinet.

* * * * *